US009631302B1

(12) United States Patent
Liu

(10) Patent No.: US 9,631,302 B1
(45) Date of Patent: Apr. 25, 2017

(54) ROPE BELT KNITTING MACHINE

(71) Applicant: KAE SHENG INDUSTRIAL CO., LTD., Lugang Township, Changhua County (TW)

(72) Inventor: Tsai-Chen Liu, Lugang Township (TW)

(73) Assignee: Kae Sheng Industrial Co., Ltd., Lugang Township (TW)

( * ) Notice: Subject to any disclaimer, the term of this patent is extended or adjusted under 35 U.S.C. 154(b) by 0 days.

(21) Appl. No.: 15/133,264

(22) Filed: Apr. 20, 2016

(51) Int. Cl.

| | |
|---|---|
| ***G06F 19/00*** | (2011.01) |
| ***D04B 15/66*** | (2006.01) |
| ***D04B 15/80*** | (2006.01) |
| ***D04C 3/24*** | (2006.01) |

(52) U.S. Cl.
CPC ..... *D04B 15/665* (2013.01); *D04B 15/80* (2013.01); *D04C 3/24* (2013.01)

(58) Field of Classification Search
CPC .... D04B 15/665; D04B 15/66; D04B 15/668; D04B 15/68; D04B 15/80; D04C 3/00; D04C 3/02; D04C 3/24; D04C 3/38; D04C 3/48
USPC ..... 700/141; 87/20, 21
See application file for complete search history.

(56) References Cited

U.S. PATENT DOCUMENTS 2,592,892 A * 4/1952 Handel ..... D04C 3/24 87/7
4,913,028 A * 4/1990 Yoshiya ..... D04C 3/22 87/33
5,732,541 A * 3/1998 Kunzelman ..... D04C 1/12 57/7
6,495,227 B1 * 12/2002 Cahuzac ..... B29C 70/22 138/123
2001/0025563 A1 * 10/2001 Bettger ..... D04C 3/18 87/33
2009/0188380 A1 * 7/2009 Dow ..... H04N 21/23424 87/11

FOREIGN PATENT DOCUMENTS

CN 201530908 U * 7/2010
CN 202830411 U * 3/2013

* cited by examiner

*Primary Examiner* — Nathan Durham
(74) *Attorney, Agent, or Firm* — Alan D. Kamrath; Kamrath IP Lawfirm, P.A.

(57) ABSTRACT

A knitting machine includes a base unit, a plurality of transmission mechanisms, a plurality of spool stands, a collecting mechanism, a driving device and a microcomputer control unit. Each of the transmission mechanisms includes a plurality of driving gears and a plurality of blades. Each of the spool stands is provided with a spool. The collecting mechanism includes a plurality of hubs each provided with a convergent holding device. When the transmission mechanisms are driven, the spool of each of the spool stands is disposed at an operation state. The collecting mechanism collects and guides the lines of the spool of each of the spool stands to perform a knitting work so as to form rope belts. Thus, the rope belts present a thick-and-thin alternating mode, a multi-layer mode or a three-dimensional mode.

7 Claims, 4 Drawing Sheets

ROPE BELT KNITTING MACHINE

BACKGROUND OF THE INVENTION

1. Field of the Invention

The present invention relates to a textile machine and, more particularly, to a rope belt knitting machine.

2. Description of the Related Art

A conventional knitting machine comprises a frame, a line release mechanism, a line collecting mechanism, a plurality of spool stands and a transmission mechanism. The transmission mechanism is mounted on the frame and includes a plurality of driving gears meshing with each other and a plurality of blades arranged above the driving gears. Each of the spool stands is mounted on the blades of the transmission mechanism. In operation, when the driving gears are rotated, the blades are rotated, so that the spool stands are transmitted to different blades to move cyclically along a predetermined orbit, and the lines on each of the spool stands is collected by the line collecting mechanism to perform a knitting operation so as to form a rope belt. The transmission mechanism is driven by a motor, so that the driving gears and the blades of the transmission mechanism are rotated simultaneously. However, the spool stands need to move cyclically along a predetermined orbit, so that the driving gears and the blades of the transmission mechanism have to be arranged in an annular manner. Thus, the rope belt cannot be knitted to have a multilayer profile. Moreover, the motor has a faster operation speed that cannot be adjusted, so that the rope belt has thin shape and cannot be made to present a thick profile.

BRIEF SUMMARY OF THE INVENTION

The primary objective of the present invention is to provide a knitting machine that performs a stabilized and precise knitting operation.

In accordance with the present invention, there is provided a knitting machine comprising a base unit, a plurality of transmission mechanisms, a plurality of spool stands, a collecting mechanism, a driving device and a microcomputer control unit. The base unit includes a frame and a worktable arranged above the frame. Each of the transmission mechanisms is mounted on the worktable of the base unit and includes a plurality of driving gears meshing with each other and a plurality of blades arranged above the driving gears. Each of the spool stands is detachably mounted on and arranged above the blades of each of the transmission mechanisms. Each of the spool stands is provided with a spool. The collecting mechanism is arranged on the worktable of the base unit and includes a plurality of hubs. Each of the hubs is provided with a convergent holding device which is disposed at a convergent state to hold and converge lines on the spool of each of the spool stands. The driving device is arranged on the worktable of the base unit and is coupled to and electrically connected with the transmission mechanisms and the collecting mechanism to drive the transmission mechanisms and the collecting mechanism. The driving device is selected from a servo motor. The microcomputer control unit is mounted on the frame of the base unit and is coupled to and electrically connected with the driving device. The microcomputer control unit controls operation of the driving device, and adjusts an operation speed of the driving device, to drive operation of the driving gears and the blades of each of the transmission mechanisms and operation of the collecting mechanism. When the driving gears of each of the transmission mechanisms are rotated, the blades of each of the transmission mechanisms are rotated, so that the spool of each of the spool stands is disposed at an operation state. The collecting mechanism collects and guides the lines of the spool of each of the spool stands to perform a knitting work so as to form rope belts, so that the rope belts present a thick-and-thin alternating mode, a multi-layer mode or a three-dimensional mode.

Preferably, the frame of the base unit includes a plurality of uprights which are connected by soldering. The worktable of the base unit is provided with a plurality of mounting holes for mounting the driving gears of the transmission mechanisms.

Preferably, the frame of the base unit is further provided with a plurality of separators corresponding to the transmission mechanisms. The number of the separators is the same as that of the transmission mechanisms.

Preferably, the collecting mechanism further includes a support post for mounting the hubs, and a plurality of winding arrangements arranged on the support post and corresponding to and disposed above the spool stands. The number of the winding arrangements is the same as that of the transmission mechanisms. Each of the winding arrangements is provided with a plurality of grooves. Each of the winding arrangements is located above each of the hubs, so that each of the hubs collects and guides the lines of the spool of each of the spool stands to the grooves of each of the winding arrangements.

Preferably, the collecting mechanism further includes a plurality of guiding racks corresponding to the winding arrangements to draw the rope belts from the winding arrangements to a rear side of the knitting machine. The number of the guiding racks is the same as that of the winding arrangements.

Preferably, the driving device is selected from a step motor or a frequency conversion motor to replace the servo motor.

Preferably, the microcomputer control unit includes a housing, an integrated circuit board mounted in the housing, and a control panel mounted on an outside of the housing. The control panel is coupled to and electrically connected with the integrated circuit board. The control panel includes an indication light, a plurality of push buttons, and a display.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
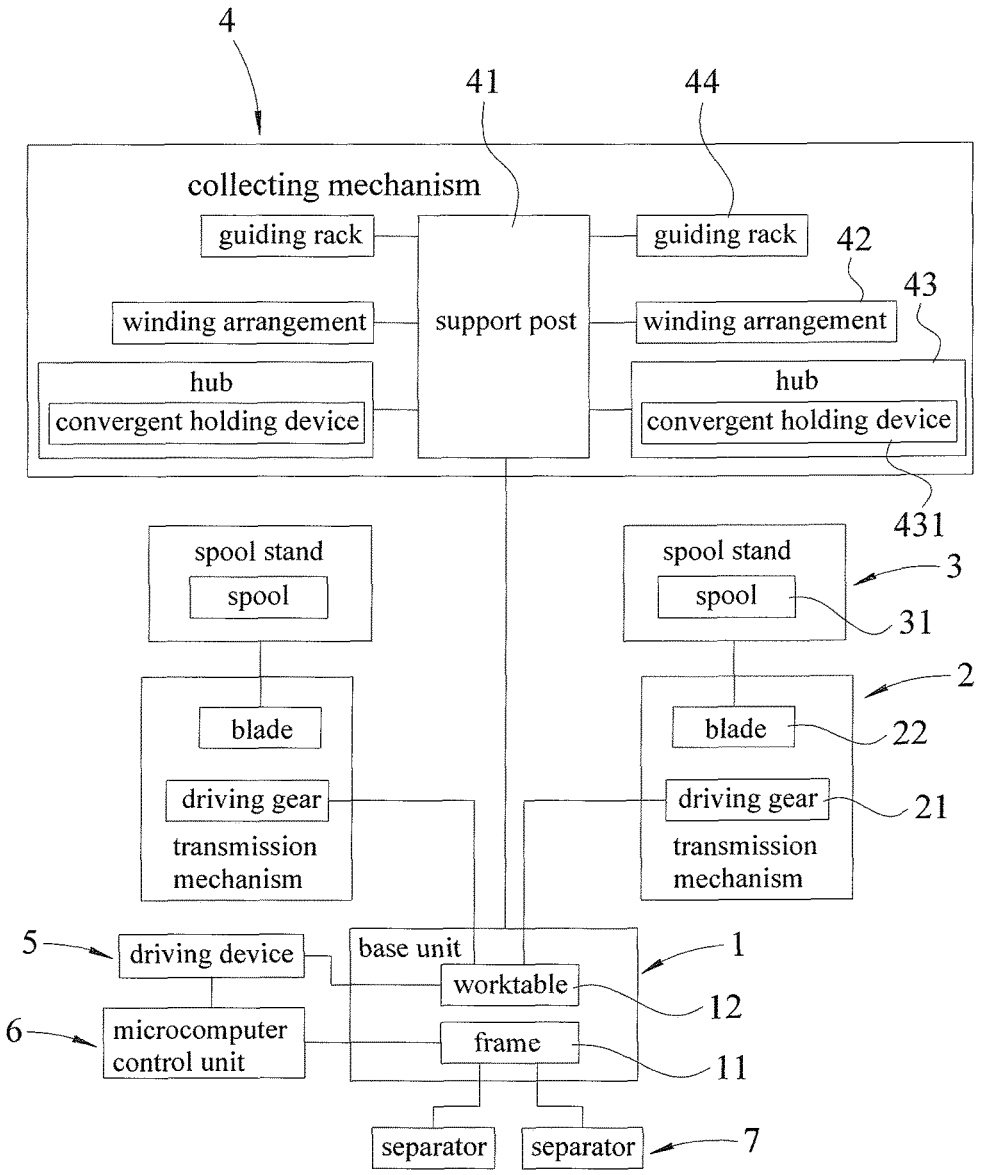
FIG. 1 is a schematic block diagram of a knitting machine in accordance with the preferred embodiment of the present invention.
Figure 2:
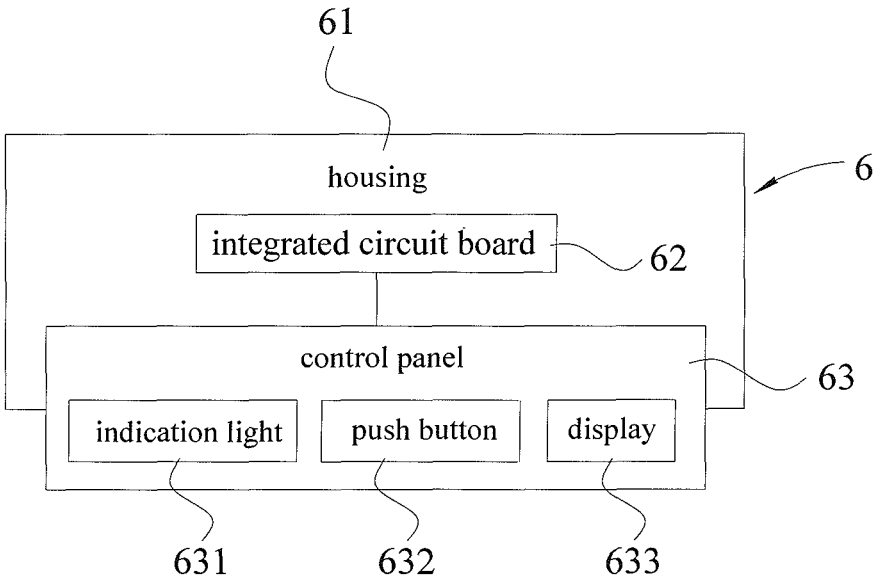
FIG. 2 is a schematic block diagram of a microcomputer control unit of the knitting machine in accordance with the preferred embodiment of the present invention.
Figure 3:
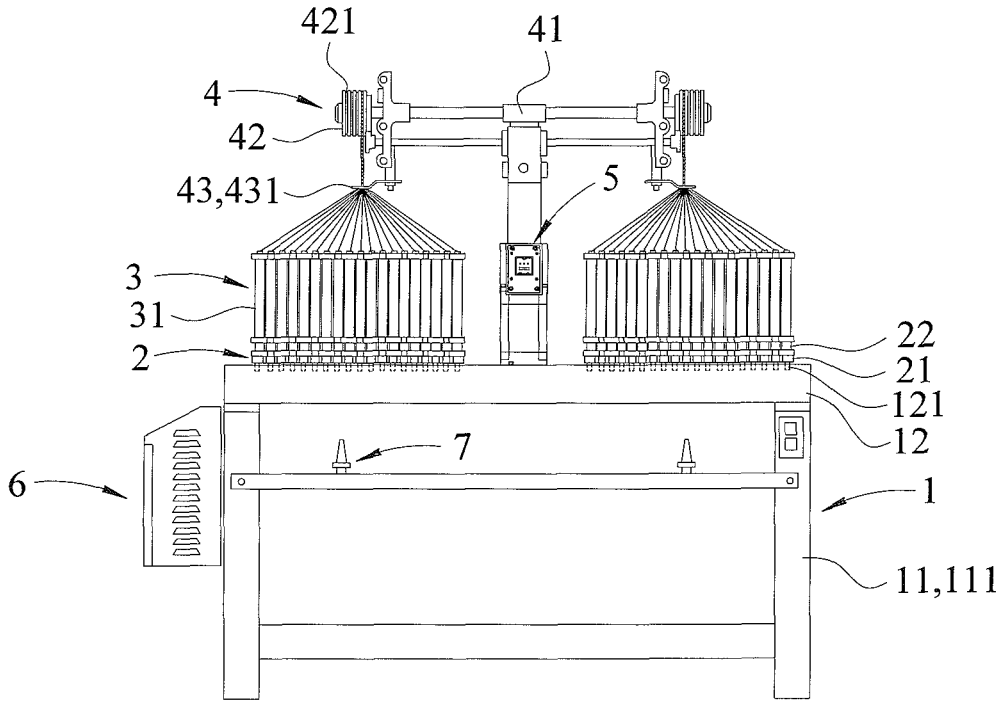
FIG. 3 is a front view of the knitting machine in accordance with the preferred embodiment of the present invention.
Figure 4:
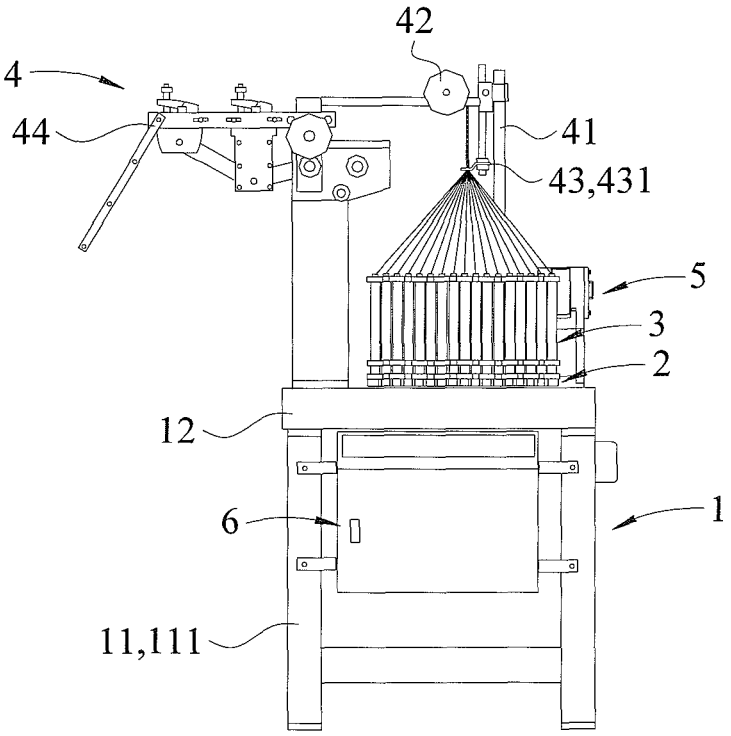
FIG. 4 is a side view of the knitting machine in accordance with the preferred embodiment of the present invention.

Referring to FIGS. 1-4, a knitting machine in accordance with the preferred embodiment of the present invention comprises a base unit 1, a plurality of transmission mechanisms 2, a plurality of spool stands 3, a collecting mechanism 4, a driving device 5, and a microcomputer control unit 6.

The base unit 1 includes a frame 11 and a worktable 12 arranged above the frame 11.

Each of the transmission mechanisms 2 is mounted on the worktable 12 of the base unit 1 and includes a plurality of driving gears 21 meshing with each other and a plurality of blades 22 arranged above and rotated by the driving gears 21.

Each of the spool stands 3 is detachably mounted on and arranged above the blades 22 of each of the transmission mechanisms 2 and is provided with a spool 31. Each of the spool stands 3 is driven and rotated by the blades 22 of each of the transmission mechanisms 2.

The collecting mechanism 4 is arranged on the worktable 12 of the base unit 1 and includes a plurality of hubs 43. Each of the hubs 43 is provided with a convergent holding device 431 which is disposed at a convergent state to hold and converge lines on the spool 31 of each of the spool stands 3.

The driving device 5 is arranged on the worktable 12 of the base unit 1 and is coupled to and electrically connected with the transmission mechanisms 2 and the collecting mechanism 4. The driving device 5 is selected from a servo motor. Preferably, the driving device 5 is selected from a step motor or a frequency conversion motor to replace the servo motor.

The microcomputer control unit 6 is mounted on the frame 11 of the base unit 1 and is coupled to and electrically connected with the driving device 5.

In the preferred embodiment of the present invention, the frame 11 of the base unit 1 includes a plurality of uprights 111 which are connected by soldering. The worktable 12 of the base unit 1 is provided with a plurality of mounting holes 121 for mounting the driving gears 21 of the transmission mechanisms 2. The frame 11 of the base unit 1 is further provided with a plurality of separators 7 corresponding to the transmission mechanisms 2. The number of the separators 7 is the same as that of the transmission mechanisms 2.

The collecting mechanism 4 further includes a support post 41 for mounting the hubs 43, and a plurality of winding arrangements 42 arranged on the support post 41 and corresponding to and disposed above the spool stands 3. The number of the winding arrangements 42 is the same as that of the transmission mechanisms 2. Each of the winding arrangements 42 is provided with a plurality of grooves 421. Each of the winding arrangements 42 is located above each of the hubs 43, so that each of the hubs 43 collects and guides the lines of the spool 31 of each of the spool stands 3 to the grooves 421 of each of the winding arrangements 42 to perform a knitting work so as to form rope belts. It is appreciated that, the convergent holding device 431 of each of the hubs 43 is disposed at a convergent state to guide the lines of the spool 31 of each of the spool stands 3 to the grooves 421 of each of the winding arrangements 42 more smoothly, and the lines present an alternating state.

The collecting mechanism 4 further includes a plurality of guiding racks 44 corresponding to the winding arrangements 42 to draw the rope belts from the winding arrangements 42 to a rear side of the knitting machine to perform a rolling or furling work. The number of the guiding racks 44 is the same as that of the winding arrangements 42.

The microcomputer control unit 6 includes a housing 61, an integrated circuit board 62 mounted in the housing 61, and a control panel 63 mounted on an outside of the housing 61. The control panel 63 is coupled to and electrically connected with the integrated circuit board 62. The control panel 63 includes an indication light 631 to indicate an ON/OFF state, a plurality of push buttons 632 for operating the microcomputer control unit 6 to present the ON/OFF state electrically or to input related data, and a display 633 to indicate messages of a whole operation state.

In practice, before the knitting machine performs the knitting operation, the user uses the push buttons 632 of the control panel 63 of the microcomputer control unit 6 to control operation of the driving device 5. When the driving device 5 is started, the indication light 631 of the control panel 63 of the microcomputer control unit 6 indicates the ON/OFF state, so that the user can watch the indication light 631 to know that the driving device 5 is disposed at an ON state. At this time, the user can use the push buttons 632 of the control panel 63 of the microcomputer control unit 6 to input related data, so as to adjust and preset an operation speed of the driving device 5, and to drive operation of the driving gears 21 and the blades 22 of each of the transmission mechanisms 2 and operation of the collecting mechanism 4. At the same time, the messages of the whole operation state are indicated on the display 633 of the control panel 63 of the microcomputer control unit 6 to facilitate the user controlling the whole operation state.

In operation, when the driving gears 21 of each of the transmission mechanisms 2 are rotated, the blades 22 of each of the transmission mechanisms 2 are rotated, so that the spool 31 of each of the spool stands 3 is disposed at an operation state. At this time, the speed of the blades 22 of each of the transmission mechanisms 2 can be adjusted to achieve a diverse variation function. Then, each of the hubs 43 collects and guides the lines of the spool 31 of each of the spool stands 3 to the grooves 421 of each of the winding arrangements 42 to perform a knitting work so as to form rope belts. At this time, the convergent holding device 431 of each of the hubs 43 is disposed at a convergent state to guide the lines of the spool 31 of each of the spool stands 3 to the grooves 421 of each of the winding arrangements 42 more smoothly. In such a manner, the rope belts present a thick-and-thin alternating mode, a multi-layer mode or a three-dimensional mode. In addition, the driving device 5 is selected from a servo motor, and the microcomputer control unit 6 controls operation of the driving device 5, so that the knitting operation is more stable and exact. Further, the user can use the microcomputer control unit 6 to input related data, so as to knit rope belts with diverse modes, thereby enhancing variation of the rope belts.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A knitting machine comprising:

a base unit, a plurality of transmission mechanisms, a plurality of spool stands, a collecting mechanism, a driving device and a microcomputer control unit;

wherein:

the base unit includes a frame and a worktable arranged above the frame;

each of the transmission mechanisms is mounted on the worktable of the base unit and includes a plurality of driving gears meshing with each other and a plurality of blades arranged above the driving gears;

each of the spool stands is detachably mounted on and arranged above the blades of each of the transmission mechanisms;

each of the spool stands is provided with a spool;

the collecting mechanism is arranged on the worktable of the base unit and includes a plurality of hubs;

each of the hubs is provided with a convergent holding device which is disposed at a convergent state to hold and converge lines on the spool of each of the spool stands;

the driving device is arranged on the worktable of the base unit and is coupled to and electrically connected with the transmission mechanisms and the collecting mechanism to drive the transmission mechanisms and the collecting mechanism;

the driving device is selected from a servo motor;

the microcomputer control unit is mounted on the frame of the base unit and is coupled to and electrically connected with the driving device;

the microcomputer control unit controls operation of the driving device, and adjusts an operation speed of the driving device, to drive operation of the driving gears and the blades of each of the transmission mechanisms and operation of the collecting mechanism;

when the driving gears of each of the transmission mechanisms are rotated, the blades of each of the transmission mechanisms are rotated, so that the spool of each of the spool stands is disposed at an operation state; and the collecting mechanism collects and guides the lines of the spool of each of the spool stands to perform a knitting work so as to form rope belts, so that the rope belts present a thick-and-thin alternating mode, a multi-layer mode or a three-dimensional mode.

2. The knitting machine of claim 1, wherein:

the frame of the base unit includes a plurality of uprights which are connected by soldering; and the worktable of the base unit is provided with a plurality of mounting holes for mounting the driving gears of the transmission mechanisms.

3. The knitting machine of claim 2, wherein;

the frame of the base unit is further provided with a plurality of separators corresponding to the transmission mechanisms; and the number of the separators is the same as that of the transmission mechanisms.

4. The knitting machine of claim 1, wherein:

the collecting mechanism further includes a support post for mounting the hubs, and a plurality of winding arrangements arranged on the support post and corresponding to and disposed above the spool stands;

the number of the winding arrangements is the same as that of the transmission mechanisms;

each of the winding arrangements is provided with a plurality of grooves; and each of the winding arrangements is located above each of the hubs, so that each of the hubs collects and guides the lines of the spool of each of the spool stands to the grooves of each of the winding arrangements.

5. The knitting machine of claim 4, wherein:

the collecting mechanism further includes a plurality of guiding racks corresponding to the winding arrangements to draw the rope belts from the winding arrangements to a rear side of the knitting machine; and the number of the guiding racks is the same as that of the winding arrangements.

6. The knitting machine of claim 1, wherein the driving device is selected from a step motor or a frequency conversion motor to replace the servo motor.

7. The knitting machine of claim 1, wherein:

the microcomputer control unit includes a housing, an integrated circuit board mounted in the housing, and a control panel mounted on an outside of the housing;

the control panel is coupled to and electrically connected with the integrated circuit board; and the control panel includes an indication light, a plurality of push buttons, and a display.

* * * * *